United States Patent [19]

Darbonnier

[11] 4,156,480

[45] May 29, 1979

[54] LUGGAGE

[76] Inventor: Pierre E. Darbonnier, 8820 Gallic Ct., El Paso, Tex. 79925

[21] Appl. No.: 914,281

[22] Filed: Jun. 8, 1978

[51] Int. Cl.[2] ..... A45C 13/26

[52] U.S. Cl. ..... 190/52; 190/57

[58] Field of Search ..... 190/49, 50, 51, 52, 190/57

[56] References Cited

U.S. PATENT DOCUMENTS

| | | | |
|---|---|---|---|
| 2,552,438 | 5/1951 | Kramer | 190/52 |
| 3,448,839 | 6/1969 | Lugash | 190/51 X |
| 3,612,232 | 10/1971 | Larson | 190/49 |
| 3,739,886 | 6/1973 | Kertzman | 190/51 X |

*Primary Examiner*—Donald F. Norton

*Attorney, Agent, or Firm*—Clarence A. O'Brien; Harvey B. Jacobson

[57] ABSTRACT

A piece of hand luggage having a frame including chamber means for carrying a jacket in a draped, unfolded mode, and a handle mounted on the frame so as to be engaged by a hand of a person carrying the luggage in such a manner as to permit the person to carry the frame with an arm associated with the hand engaging the handle disposed extending substantially vertically downwardly. The frame is formed from a pair of enclosure portions, the upper area of each of which is provided with a pair of substantially coplanar ledges jutting toward one another from associated side walls which are spaced when the two enclosure portions are in a position abutting one another along mating surfaces so as to provide a well in which the handle is disposed. The two enclosure portions are hingedly connected to one another along one end thereof so as to permit opening and closing of the frame, while the sections of the enclosure portions which extend above the ledges thereof are provided with access openings selectively blocked by zippered flaps so as to permit access into the chamber of the frame while the two enclosure portions are in juxtaposition with one another.

10 Claims, 4 Drawing Figures

LUGGAGE

BACKGROUND OF THE INVENTION

1. Field of the Invention

This invention relates generally to luggage, and particularly to hand luggage suitable for carrying suits, and the like, without the necessity of folding the suit jackets and similar garments.

2. Description of the Prior Art

It is known generally to provide hand luggage suitable for carrying garments without the necessity of folding the garments, which folding can cause wrinkling and the like. Examples of such luggage can be found in U.S. Pat. Nos. 2,841,257, issued July 1, 1958, to E. R. Dallas; 3,448,839, issued June 10, 1969, to M. J. Lugash; and 3,612,232, issued Oct. 12, 1971, to W. E. Larson. These three examples of hand luggage are essentially the same inasmuch as they all provide a carrying handle disposed midway on the outer surface of the piece of luggage so as to permit the luggage to be carried under the arm of a person using the luggage.

U.S. Pat. Nos. 1,051,937, issued Feb. 4, 1913, to G. H. Wheary; 3,452,846, issued July 1, 1969, to E. Joachim; and 3,726,329, issued Apr. 10, 1973, to J. W. Dean, disclose examples of luggage formed in two or more parts selectively connectible to one another in such a manner as to form an enclosed unit, while U.S. Pat. Nos. 1,930,043, issued Oct. 10, 1933, to L. E. Evens, and 3,559,777, issued Feb. 2, 1971, to K. L. Gardner, disclose examples of luggage provided with zippered flaps permitting selective access to the interior of the bag.

SUMMARY OF THE INVENTION

It is an object of the present invention to provide a piece of hand luggage which is easy to carry, yet eliminates the need of folding suits, and the like, and therefore wrinkling of the garments.

It is another object of the present invention to provide a piece of hand luggage wherein the weight is balanced equally about a carrying handle of the luggage, even though suits, and the like, can be disposed within the piece of luggage in an unfolded mode so as to prevent wrinkling.

It is yet another object of the present invention to provide a piece of hand luggage which permits suits and similar garments to be carried in unfolded position, yet permits the luggage to be carried in the manner of a normal suitcase and hung on a garment rack, and the like, in the manner of a garment bag.

These and other objects are achieved according to the present invention by providing a piece of hand luggage having: a frame including chamber means for carrying a jacket, and the like, in draped, unfolded mode; and a handle arrangement mounted on the frame for being engaged by a hand of a person and permitting the person to carry the frame with an arm associated with the hand being disposed engaging the handle arrangement in a position extending substantially straight downwardly.

The frame of the piece of luggage advantageously comprises first and second enclosure portions each forming a receptacle and both being pivotally connected together for forming an enclosure when in juxtaposition. Each of the first and second enclosure portions preferably includes a top wall, bottom wall, a pair of substantially parallel, spaced end walls, and an outside directed side wall, with the end walls and side wall extending between the top wall and bottom wall. A further side wall extends from the top portion of the enclosure portions toward, but spaced from the bottom wall thereof, with a ledge terminating these further, inside side walls and extending perpendicularly thereto toward the other of the first and second enclosure portions. The ledge of each of the enclosure portions cooperates with the ledge of the other of the enclosure portions to form a well between the top walls of the enclosure portions which well extends toward, but is spaced from the bottom walls of the enclosure portions.

The handle arrangement includes a handle disposed within the well and mounted on one of the ledges of the enclosure portions preferably as close practical to the other of the ledges. In particular, it is contemplated that the handle will be mounted on the ledge of the one of the enclosure portions of the frame which is intended to be carried closest to the body of a person using the piece of luggage according to the invention.

Each of the inside side walls is provided with an opening which permits access to the interior of the associated one of the enclosure portions of the frame, with a flap being attached to the associated interior side wall for selectively blocking the opening by use of a conventional zipper, and the like, so as to permit access into the interior of the frame of the luggage without pivotally opening the luggage by a swinging movement of the enclosure portions relative to one another.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
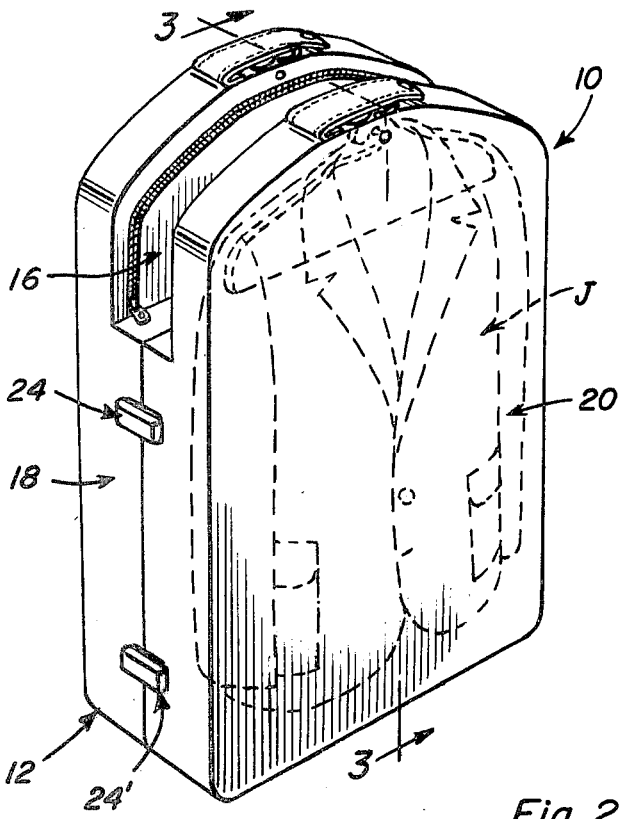
FIG. 1 is a perspective view showing a piece of luggage according to the present invention.

Referring now more particularly to the figures of the drawing, a piece of hand luggage 10 according to the present invention includes a frame 12 forming an interior chamber arranged for carrying coats, jackets, and the like, in draped, unfolded mode, as in the manner illustrated in broken lines in FIG. 1 by the jacket J. A handle 14 is mounted on frame 12 in the bottom of a well 16 formed in the upper section of luggage 10 and is arranged for being engaged by a hand H of a person using the luggage so as to permit the person to carry the frame 12 of luggage 10 with an arm associated with the hand engaging the handle 14 being disposed extending substantially straight downwardly for comfort and convenience in carrying luggage 10.

Figure 4:
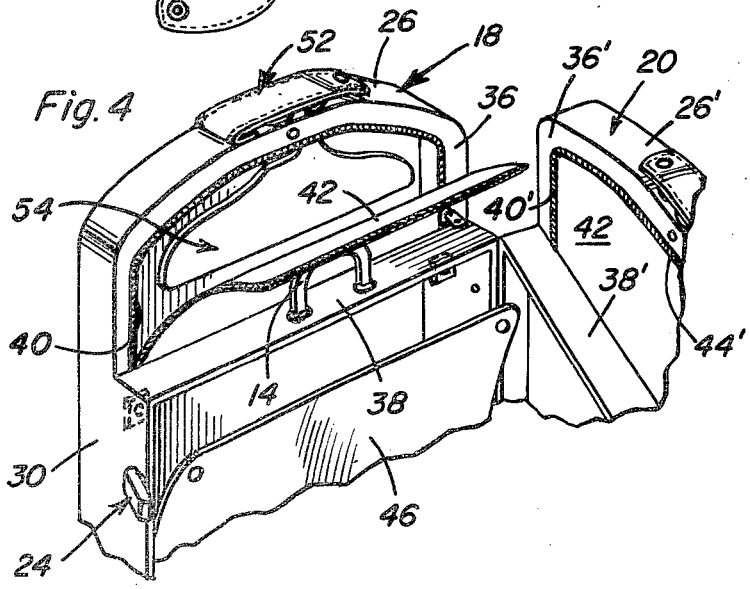
FIG. 4 is an enlarged, fragmentary, perspective view, similar to the upper portion of FIG. 1, but showing the piece of luggage in an opened, packing and unpacking, mode.

Frame 12 comprises a first enclosure portion 18 and a second enclosure portion 20 each forming a receptacle and being pivotally connected together as by conventional hinges 22 for forming an enclosure when in juxtaposition to one another, as seen in FIG. 1. When portions 18 and 20 are swung away from each other about the pivot axis formed by hinges 22, as seen in FIG. 4, it will be appreciated that complete access can be had to the interior chamber of frame 12. Suitable locks 24, of conventional construction, can be employed on the ends or edges of frame 12 spaced directly across from the walls on which hinges 22 are disposed in order to permit portions 18 and 20 to be retained in juxtaposition to one another, as seen in FIG. 1.

Figure 2:
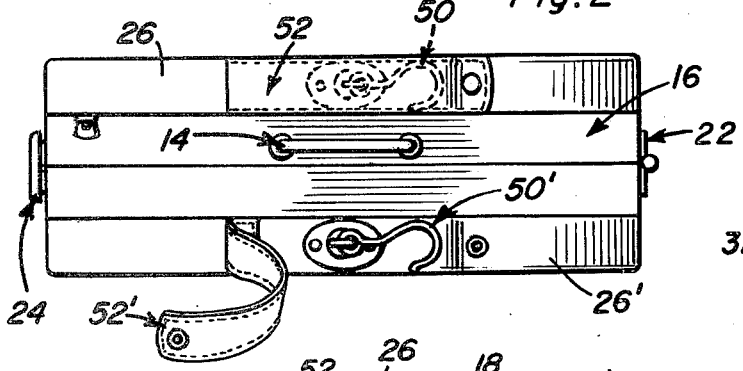
FIG. 2 is an enlarged, top plan view, with one part shown in a moved position, showing the piece of luggage of FIG. 1.
Figure 3:
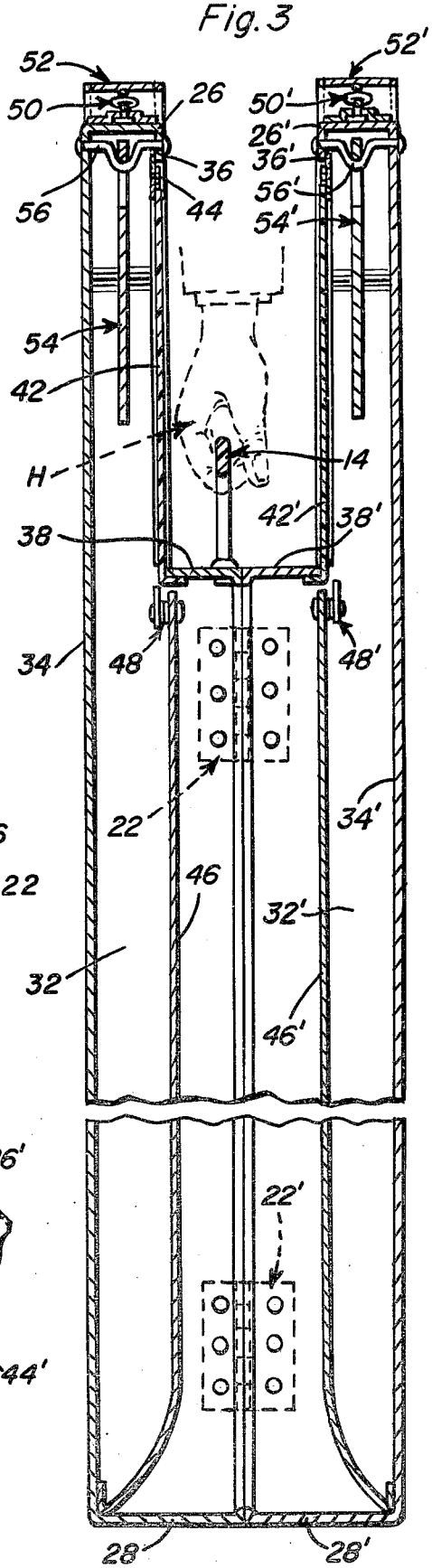
FIG. 3 is an enlarged, fragmentary, sectional view taken generally along the line 3—3 of FIG. 1.

The enclosure portions 18 and 20 each include, respectively, a top wall 26, 26', a bottom wall 28, 28' spaced vertically from top wall 26, 26', a pair of substantially parallel, vertically extending and horizontally spaced end walls 30, 32 and 30', 32', and an outside side wall 34, 34'. Further, inside side walls 36, 36', respectively, extend from the top wall 26, 26' of each of the portions 18 and 20 so as to extend perpendicularly from the associated top wall 26, 26' toward a midpoint of the width of the associated bottom wall 28, 28' and toward, but spaced from, the bottom wall 28, 28', and terminates in a perpendicularly disposed ledge 38, 38'. It will be appreciated especially from FIG. 3 of the drawing that the ledges 38, 38' are substantially coplanar and extend toward one another the remaining distance, or one-half the width, of the bottom wall 28, 28', with each of the top walls 26, 26' being only substantially one-half the width of the associated bottom wall 28, 28', so as to complete the enclosed chamber formed by the portions 18 and 20 when same are in juxtaposition as seen in FIGS. 1 through 3. As can be seen from the drawing, the inside side walls 36, 36' cooperate with their respective ledges 38, 38' and with one another to form well 16. Handle 14 is disposed on one of the ledges, ledge 38 as illustrated, as close to the inside edge of this ledge as possible so as to place handle 14 substantially in the vertical plane passing through the center of gravity of frame 12. The actual center of gravity of frame 12 will usually be located beneath the point of attachment of handle 14. By this arrangement, it can be appreciated that handle 14 will be arranged relative to frame 12, and more specifically the portions 18 and 20 thereof, as to permit balanced carrying of luggage 10. That is, one coat or suit can be hung in portion 18 and another coat or suit in portion 20, and assuming the total weight of each is substantially the same, the weight of the suitcase will be balanced equally under the arm (not shown) of a person carrying luggage 10.

Each of the inside side walls 36, 36' has provided therein an opening 40, 40', respectively, affording access to the interior of the respective enclosure portion 18, 20. A flap 42, 42' is attached to, and forms an extension of, the respective side walls 36, 36' and is provided with a zipper part which cooperates selectively with a mating part provided on the associated side wall 36, 36' to form a zipper 44, 44' in order to permit the flap 42, 42' to selectively block the associated opening 40, 40'. In this manner, access can be had to the interior of the enclosure portions 18, 20 without necessity of swinging the portions 18, 20 away from one another in the manner shown in FIG. 4 of the drawing.

In addition, each of the enclosure portions 18, 20 is provided with a respective flexible divider 46, 46' attached to the associated bottom wall 28, 28', preferably at the juncture therewith with the associated outside side wall 34, 34', and terminates at its upper end with a conventional fastener 48, 48' which permits attachment of divider 46, 46' to a respective one of the ledges 38, 38', preferably at the juncture of such ledge 38, 38' to an associated one of the inside side walls 36, 36', in order to separate the outside section or area of the respective enclosure portion 18, 20 from the inside section or area thereof and, thus, separate coats, suits, and the like, from other garments and accessories, such as underwear, shoes, and the like.

Conventional hook arrangers 50, 50' are swivel mounted to the respective top walls 26, 26' centrally thereof for permitting frame 12 to be supported from a garment hanging bar (not shown) and the like, as can conventionally provided in aircraft garment storage areas, in closets, and in other suitable storage locations. Covers 52 and 52' are arranged adjacent hooks 50, 50', respectively, for selectively covering hooks 50, 50' when the latter are in a stored, unused position, such as seen in FIG. 1, with suitable snap fasteners, and the like, being employed at the free ends of these covers 52, 52' to facilitate attachment of the covers to top wall 26 in covering flap fashion in order to conceal hooks 50, 50' when same are not being used. Further, suitable coat hangers 54, 54' are suspended on the generally U-shaped bars 56, 56' provided in the upper section of enclosure portions 18, 20, respectively, in order to facilitate the hanging of suit jackets, coats, and the like, within the chambers formed by the receptacle-shaped enclosure portions 18 and 20.

As can be readily understood from the above description and from the drawing, a piece of hand luggage according to the present invention provides two-suit capability in a compact and easily carried article which facilitates balancing of weight in the luggage and which permits grasping and carrying of the luggage in a manner which is comfortable and convenient for the user of the luggage. While a two-suit case has been disclosed, it will be understood that variations in the relative proportions of the article can be made in order to permit same to carry more suits, if desired. Provision of the pair of hangers on the top walls of the frame of the case assure that same will be hung in a balanced position when stored on garment supporting bars, and the like.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A piece of hand luggage comprising, in combination:

(a) a frame including chamber means for carrying a coat, jacket, and the like, in a draped, unfolded mode; and (b) handle means mounted on the frame for being engaged by a hand of a person and permitting the person to carry the frame with an arm associated with the hand being disposed engaging the handle means in a downwardly extending position, said frame comprising first and second enclosure portions each forming a receptacle and both being pivotally connected together for forming an enclosure when in juxtaposition, each of the first and second enclosure portions including a top wall, a pair of substantially parallel, spaced end walls, and an outside side wall, with the end walls and the outside side wall extending between the top wall and bottom wall, the top wall being only substantially half the width of the bottom wall, and a further, inside side wall extending from the top wall toward, but terminating in spaced relation to the bottom wall, the further inside side walls being spaced from one another when the enclosure portions are in juxtaposition, and a ledge terminating the further, inside side wall of each of the enclosure portions, the ledges extending toward one another and being substantially perpendicular to the side walls, the ledge of each of the enclosure portions cooperating with the ledge of the other of the closure portions to form a well in conjunction with the inside side walls, the well extending toward, but terminating in a bottom surface spaced from the bottom wall.

2. A structure as defined in claim 1, wherein the handle means includes a handle mounted on one of the ledges of the enclosure portions.

3. A structure as defined in claim 1, wherein each of the inside side walls has an opening providing access to the interior of the associated enclosure portion, with each of the enclosure portions being provided with a respective flap attached to the inside side wall along one side of the opening provided therein and removably attachable to the side wall along other edges of the opening for selectively blocking and unblocking the opening.

4. A structure as defined in claim 1, wherein each of the enclosure portions is provided with a flexible divider attached to the bottom wall of the respective ones of the enclosure portions and removably attachable to the ledge of the associated enclosure portion so as to selectively divide the associated enclosure portion into two sections.

5. A structure as defined in claim 4, wherein the handle means includes a handle mounted on one of the ledges of the enclosure portions.

6. A structure as defined in claim 5, wherein each of the inside side walls has an opening providing access to the interior of the associated enclosure portion, with each of the enclosure portions being provided with a respective flap attached to the inside side wall along one side of the opening provided therein and removably attachable to the side wall along other edges of the opening for selectively blocking and unblocking the opening.

7. In a piece of hand luggage comprising a frame including first and second enclosure portions each forming a receptacle and both being pivotally connected to one another for forming an enclosure when in juxtaposition, and a handle means mounted on the frame for being engaged by a hand of a person and permitting the person to carry the frame with an arm associated with the hand engaging the handle means being disposed extending substantially vertically downwardly, the improvement wherein the handle means includes a well formed in an upper portion of the frame, and a handle provided in the well, each of the first and second enclosure portions including a top wall, a bottom wall, a pair of substantially parallel, spaced end walls, and an outside side wall, with the end walls and the side wall extending between the top wall and the bottom wall, the top wall being only substantially one-half the width of the associated bottom wall, and an inside side wall extending from the associated top wall toward, but terminating in spaced relation from the associated bottom wall, and a ledge terminating the inside side wall and extending perpendicularly therefrom, the ledges of each of the first and second enclosure portions being substantially coplanar and cooperating with the inside walls to form the aforementioned well when the enclosure portions are in juxtaposition with respect to one another in order to form an article-containing enclosure.

8. A piece of hand luggage including first and second enclosure structures each including remote open and closed sides interconnected by first and second pairs of remote peripheral walls extending therebetween, one set of corresponding peripheral walls of the first pairs of peripheral walls including complementary first and second sections thereof extending from said open and closed sides toward said closed and open sides, respectively, said first sections being displaced, relative to said second sections, inwardly and closer to the remote peripheral wall, each enclosure structure including inside wall structure extending between the inner marginal portions of the first and second sections thereof and the adjacent portions of the second pair of remote peripheral walls thereof and closing the corresponding areas of said open sides, securing means releasably securing said enclosure structures together in closed positions with portions of said open sides not closed by said inside wall structures opening into each other and for relative movement of said enclosure structures, upon release of said securing means, toward open position with said open side portions exposed for access into the interiors of said enclosure structures through said portions of said open sides, said inside wall structures, when said enclosure structures are secured together in said closed positions, being spaced apart a distance amply sufficient to receive a person's closed hand therebetween, at least one of said enclosure structures including handle means disposed within the space between said inside wall structures and adapted to be gripped by and supported from a closed hand received in the space between said inside wall structures.

9. The combination of claim 8 wherein said inside wall structures define openings therein, and means removably closing the last mentioned openings.

10. The combination claim 8 wherein said securing means includes hinge means hingedly connecting one set of corresponding peripheral walls of said second pairs of peripheral walls of said enclosure structures and coacting latch means releasably latching the other set of corresponding peripheral walls of said second pairs of peripheral walls of said enclosure structures.

* * * * *